US010990042B2

(12) United States Patent
Ohmori et al.

(10) Patent No.: US 10,990,042 B2
(45) Date of Patent: Apr. 27, 2021

(54) INTERMEDIATE TRANSFER BELT, IMAGE FORMING APPARATUS, AND IMAGE FORMING METHOD

(71) Applicants: Masahiro Ohmori, Kanagawa (JP); Hidetaka Kubo, Kanagawa (JP)

(72) Inventors: Masahiro Ohmori, Kanagawa (JP); Hidetaka Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/784,444

(22) Filed: Feb. 7, 2020

(65) Prior Publication Data

US 2020/0285173 A1 Sep. 10, 2020

(30) Foreign Application Priority Data

Mar. 6, 2019 (JP) ..... JP2019-040620

(51) Int. Cl.
*G03G 15/20* (2006.01)
*G03G 15/16* (2006.01)

(52) U.S. Cl.
CPC ..... *G03G 15/161* (2013.01)

(58) Field of Classification Search
CPC ..... G03G 15/162; G03G 15/161; G03G 15/1605; G03G 15/1615; C08K 3/04
USPC ..... 399/308
See application file for complete search history.

(56) References Cited

U.S. PATENT DOCUMENTS

2007/0218380 A1* 9/2007 Uchinokura ..... G03G 9/0827 430/108.1
2008/0075489 A1* 3/2008 Hayashi ..... G03G 15/1605 399/45
2008/0248278 A1* 10/2008 Fisher ..... B32B 5/02 428/304.4
2010/0215902 A1* 8/2010 Kiehne ..... B32B 17/10788 428/141
2010/0239332 A1* 9/2010 Suzuki ..... B05D 3/108 399/302
2013/0334014 A1 12/2013 Mashiko et al.
2014/0356042 A1 12/2014 Gondoh et al.
2015/0023707 A1 1/2015 Gohda et al.
2015/0117896 A1 4/2015 Sugimoto et al.
2015/0139711 A1 5/2015 Gohda et al.
2015/0212479 A1 7/2015 Toyama et al.
2015/0241817 A1 8/2015 Kubo et al.
(Continued)

FOREIGN PATENT DOCUMENTS

JP 2012-194282 10/2012
JP 2013-109262 6/2013
JP 2014-002203 1/2014

*Primary Examiner* — Walter L Lindsay, Jr.
*Assistant Examiner* — Frederick Wenderoth
(74) *Attorney, Agent, or Firm* — Oblon, McClelland, Maier & Neustadt, L.L.P.

(57) ABSTRACT

An intermediate transfer belt is provided onto which a toner image obtained by developing a latent image formed on an image bearer with a toner is transferred. The intermediate transfer belt includes a base layer and an elastic layer laminated on the base layer. The elastic layer includes an ether-based urethane rubber and particles. The elastic layer has a flame retardancy of vertical thin material (VTM)-1 or higher in UL94-VTM test, and the intermediate transfer belt has a Martens hardness of 0.3 to 0.6 N/mm$^2$ and an elastic power of 60% to 85%.

20 Claims, 5 Drawing Sheets

(56) References Cited

U.S. PATENT DOCUMENTS

| | | | | |
|---|---|---|---|---|
| 2015/0253722 | A1 | 9/2015 | Sakaguchi et al. | |
| 2015/0261139 | A1 | 9/2015 | Kubo et al. | |
| 2015/0261171 | A1 | 9/2015 | Gondoh et al. | |
| 2016/0004206 | A1 | 1/2016 | Sakaguchi et al. | |
| 2016/0004207 | A1 | 1/2016 | Sakaguchi et al. | |
| 2016/0033925 | A1 | 2/2016 | Sakon et al. | |
| 2016/0274527 | A1 | 9/2016 | Gohda et al. | |
| 2017/0003643 | A1 | 1/2017 | Aoyama et al. | |
| 2017/0017194 | A1 | 1/2017 | Toyama et al. | |
| 2017/0115591 | A1* | 4/2017 | Terada | G03G 15/0233 |
| 2017/0269513 | A1 | 9/2017 | Kubo et al. | |
| 2017/0308000 | A1* | 10/2017 | Fujisawa | G03G 15/0818 |
| 2018/0017930 | A1 | 1/2018 | Aoyama et al. | |
| 2018/0239297 | A1 | 8/2018 | Juri et al. | |
| 2018/0267435 | A1 | 9/2018 | Kubo | |
| 2019/0227463 | A1 | 7/2019 | Kubo et al. | |

* cited by examiner

INTERMEDIATE TRANSFER BELT, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-040620, filed on Mar. 6, 2019, in the Japan Patent Office, the entire disclosure of which is incorporated by reference herein.

BACKGROUND

Technical Field

The present disclosure relates to an intermediate transfer belt, an image forming apparatus, and an image forming method.

Description of the Related Art

Conventionally, in electrophotographic image forming apparatuses, seamless belts have been used as members for various applications. In recent full-color electrophotographic image forming apparatuses, an intermediate transfer belt method is used, in which developed images of four colors yellow, magenta, cyan, and black are once superposed on an intermediate transfer belt, and then collectively transferred onto a recording medium such as paper.

The intermediate transfer belt method has been used in a system that four color image development equipments are used for one photoconductor, but the method has a disadvantage of a slow print speed. For this reason, for high-speed printing, a quadruple tandem method is used, in which four photoconductors are arranged for respective color images, and each color image is continuously transferred onto a recording medium such as paper sheet. However, in the quadruple tandem method, it is very difficult to equalize positional precisions for superposing each color image due to fluctuations of the recording medium such as paper sheet and the like caused in association with an environment, and color-shifted images have been caused. Thus, recently, the intermediate transfer method has been mainly adopted for the quadruple tandem method.

Under such circumstances, requisite characteristics (high-speed transfer, positional precision) of the intermediate transfer belt have also become stricter than before, and it has become required to satisfy characteristics corresponding to these requirements. In particular, for the positional precision, it is required to suppress fluctuations caused in association with deformations such as elongation of the intermediate transfer belt itself due to continuous use. The intermediate transfer belt is laid out over a wide area of the apparatus, and is required to be flame-retardant because a high voltage is applied for image transfer. To meet such requirements, a polyimide resin, a polyamideimide resin, and the like that have a high elastic modulus and a high heat resistance are mainly used as the material of the intermediate transfer belt.

In recent years, full-color electrophotographic image forming apparatuses are often used to form images on various recording media. In addition to ordinary smooth recording media, slippery recording media having a high smoothness such as coated paper, as well as recording media having a rough surface such as recycled paper, embossed paper, Japanese paper, and kraft paper have been increasingly used. Followability to such a recording medium having a rough surface is significant, and if the followability is poor, unevenness in shade and color tone is caused due to irregularity of the recording medium.

To solve the above problems, an intermediate transfer belt in which relatively irregular elastic layers are laminated on a base layer has been proposed. In addition, a method of laying a new protective layer on the elastic layer has also been proposed, but the method has a problem that if a material having a sufficiently high transfer performance is applied as the protective layer, the protective layer is not able to follow the irregularity of the elastic layer, causing cracks and peeling. Furthermore, there has been a proposal to improve transferability by attaching particles to the surface of the intermediate transfer belt.

BRIEF SUMMARY

In accordance with some embodiments of the present invention, an intermediate transfer belt is provided onto which a toner image obtained by developing a latent image formed on an image bearer with a toner is transferred. The intermediate transfer belt includes a base layer and an elastic layer laminated on the base layer. The elastic layer includes an ether-based urethane rubber and particles. The elastic layer has a flame retardancy of vertical thin material (VTM)-1 or higher in UL94-VTM test, and the intermediate transfer belt has a Martens hardness of 0.3 to 0.6 $N/mm^2$ and an elastic power of 60% to 85%.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
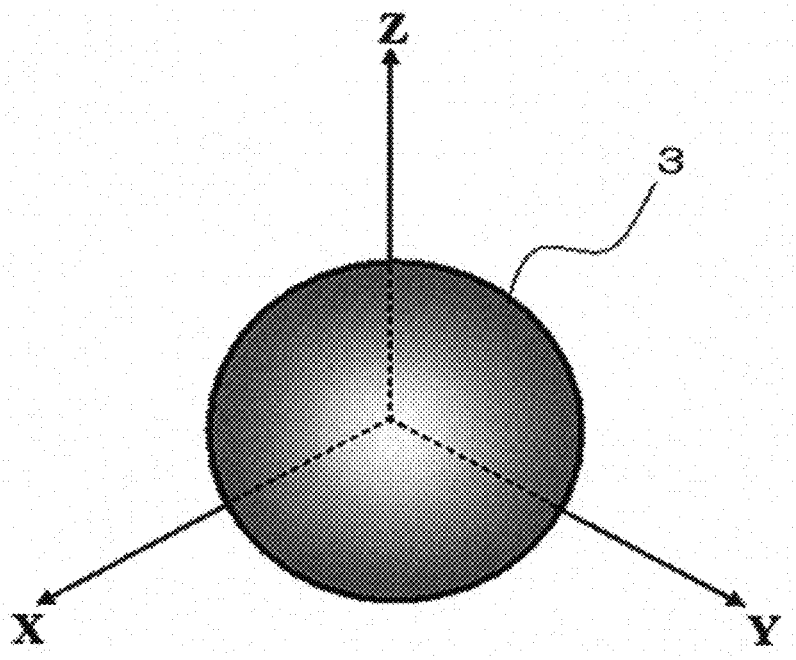
FIG. 1 is a schematic view illustrating a shape of a spherical particle.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In related art, an intermediate transfer belt in which a relatively flexible elastic layer is laminated on a high-hardness base layer has been proposed. It is said that since the intermediate transfer belt having the elastic layer has good adhesiveness with paper as a transfer material on a transfer site, the intermediate transfer belt can achieve a high transfer performance regardless of a type and a surface shape of the transfer material.

An intermediate transfer belt including a relatively-low-cost urethane rubber as an elastic layer has also been proposed.

However, since a high voltage is applied to the intermediate transfer belt at the time of transfer, the intermediate transfer belt is required to have high flame retardancy of at least VTM-1 or higher in the UL94-VTM test. In recent years, cost reduction has been demanded even for such highly functional members. Except for some types of rubbers such as fluororubber, rubber iw generally very flammable and requires the addition of large amounts of flame retardant components.

To achieve both of low cost and flame retardancy in a case in which acrylic rubber is used for the elastic layer, there is a problem that both the material and the manufacturing cost are expensive, since acrylic rubber is relatively expensive among various types of rubbers, a rubber kneading step is required for uniform dispersion of flame retardant components and the like, and, in order to form a thin elastic layer of 600 μm or less on a base layer of polyimide or the like with high accuracy, a rubber compound must be dissolved in an organic solvent and then applied thereto.

Urethane rubber is a typical rubber in a liquid state that does not require a kneading step. However, due to the molecular structure of urethane, it urethane contains oxygen and nitrogen, so it is very easy to burn. However, there is a problem that if a flame retardant component sufficient to secure VTM-1 or more is added, the elastic layer becomes extremely hard and does not function as an elastic layer.

In accordance with some embodiments of the present invention, an intermediate transfer belt having excellent followability to irregularity of a recording medium, high flame retardancy, and excellent durability is provided.

(Intermediate Transfer Belt)

The intermediate transfer belt according to an embodiment of the present invention is an intermediate transfer belt onto which a toner image obtained by developing a latent image formed on an image bearer with a toner is transferred. The intermediate transfer belt characteristically includes a base layer and an elastic layer that are laminated, the elastic layer includes an ether-based urethane rubber and particles, the elastic layer has a flame retardancy of VTM-1 or higher in UL94-VTM test, and the intermediate transfer belt has a Martens hardness of 0.3 to 0.6 N/mm$^2$ and an elastic power of 60% to 85%. In addition, the intermediate transfer belt according to an embodiment of the present invention further includes other members, as required.

<Base Layer>

The base layer contains a resin and an electric resistance adjusting agent, and may contain other components, as required.

—Resin—

From the viewpoint of flame retardancy, examples of the resin include, but are not limited to: a fluorine resin such as polyvinylidene difluoride (PVDF) and ethylene-tetrafluoroethylene copolymer (ETFE); a polyimide resin; and polyamideimide resin. Above all, the polyimide resin or the polyamideimide resin is preferable from the viewpoint of mechanical strength (high elasticity) and heat resistance.

The polyimide resin or the polyamideimide resin is not particularly limited and can be appropriately selected depending on the intended purpose. For example, general-purpose articles manufactured by manufacturers such as DU PONT-TORAY CO., LTD., Ube Industries, Ltd., New Japan Chemical Co., Ltd., JSR Corporation, UNITIKA LTD., I.S.T Corporation, Hitachi Chemical Co., Ltd., TOYOBO CO., LTD., and Arakawa Chemical Industries, Ltd. can be obtained and used.

—Electric Resistance Adjusting Agent—

The electric resistance adjusting agent is not particularly limited and can be appropriately selected depending on the intended purpose. Examples of the electric resistance adjusting agent include, but are not limited to, a metal oxide, a carbon black, an ionic conductive agent, and a conductive polymer.

Examples of the metal oxide include, but are not limited to, zinc oxide, tin oxide, titanium oxide, zirconium oxide, aluminum oxide, and silicon oxide. In addition, for improving dispersibility, a metal oxide that has been previously subjected to surface treatment, or the like is used.

Examples of the carbon black include, but are not limited to, Ketjen black, furnace black, acetylene black, thermal black, and gas black.

Examples of the ionic conductive agent include, but are not limited to, tetraalkylammonium salt, trialkylbenzylammonium salt, alkylsulfonate, alkylbenzene sulfonate, alkylsulfate, glycerol fatty acid ester, sorbitan fatty acid ester, polyoxyethylene alkylamine, polyoxyethylene fatty alcohol ester, alkylbetaine, and lithium perchlorate.

Examples of the conductive polymer include, but are not limited to, polyparaphenylene, polyaniline, polythiophene, and polyparaphenylenevinylene.

The electric resistance adjusting agents may be used alone or in combination.

A proportion of the electrical resistance adjusting agent in the base layer is not particularly limited, and can be appropriately selected according to the intended purpose. However, when the electrical resistance adjusting agent is the carbon black, the proportion in the base layer is preferably 10% by mass or more to 25% by mass or less, more preferably 15 mass or more to 20% by mass or less. In addition, when the electrical resistance adjusting agent is the metal oxide, the proportion in the base layer is preferably 1% by mass or more to 50% by mass or less, more preferably 10% by mass or more to 30% by mass or less.

When the proportion is not less than the lower limit value in the preferable range, an effect of adjusting the electric resistance is exerted, and when the proportion is not more than the upper limit value in the preferable range, a good mechanical strength is exerted for the intermediate transfer belt.

—Other Components—

Examples of the other components include, but are not limited to, a dispersion aid, a reinforcing agent, a lubricant, a heat conducting agent, and an antioxidant.

An average thickness of the base layer is not particularly limited, and can be appropriately selected depending on the intended purpose, but is preferably 30 μm or more to 150 μm or less, more preferably 40 μm or more to 120 μm or less, in particular preferably 50 μm or more to 80 μm or less.

The average thickness of the base layer is advantageously 30 μm or more to 150 μm or less from the viewpoint of durability of the intermediate transfer belt.

Incidentally, regarding the base layer, it is preferable to reduce unevenness of the thickness as much as possible for improving running stability.

A method for measuring the average thickness of the base layer is not particularly limited, and can be appropriately selected according to the intended purpose. Examples of the measuring method include, but are not limited to, a measuring method using a contact type or eddy current type film thickness meter, and a measuring method of scanning a cross section of a film using a scanning electron microscope (SEM).

<Elastic Layer>

The elastic layer includes an ether-based urethane rubber and particles. As the particles, spherical particles are preferable. The elastic layer has an irregular surface due to the spherical particles. The elastic layer further contains other components, as required.

The irregular shape of the elastic layer surface can be confirmed e.g. by observation using LEXT OLS 4100 manufactured by Olympus Corporation.

—Polyetherpolyol—

The ether-based urethane rubber can be obtained by adding isocyanate and optionally alcohol and/or amine to a polyetherpolyol. Examples of the polyetherpolyol include, but are not limited to, polypropyleneglycol (PPG) and polytetramethylene ether glycol (PTMG).

—Isocyanate—

Examples of the isocyanate include, but are not limited to: an aromatic compound such as toluene diisocyanate (TDI), diphenylmethane diisocyanate (MDI), xylene diisocyanate (XDI), and naphthalene diisocyanate (NDI); an aliphatic compound such as 1,5-pentamethylene diisocyanate (PDI), 1,6-hexamethylene diisocyanate (HDI), isophorone diisocyanate (IPDI), norbornane diisocyanate (NBDI), dicyclohexylmethane diisocyanate (hydrogenated MDI); and their polymeric products, biuret-modified products, allophanate-modified products, and nurate-modified products.

—Prepolymer—

The polyetherpolyol is sold by various manufacturers as a prepolymer having a terminal to which any of the isocyanates is added. Since isocyanate is highly toxic when used alone, it is preferable to use the prepolymer as a starting material for producing an urethane rubber. Examples of the prepolymer include, but are not limited to, CORONATE-CORONATE series manufactured by Tosoh Corporation, TAKELAC series manufactured by Mitsui Chemicals, Inc., and PRIMEPOL series manufactured by Sanyo Chemical Industries, Ltd.

—Crosslinking Agent—

In addition, as a crosslinking agent, an alcohol or an amine having a relatively low molecular weight (several tens to several hundreds) is used for adjusting rubber characteristics to within a certain range. The type of the crosslinking agent is not particularly limited, and a variety of crosslinking agents covering from aliphatic compounds to aromatic compounds having 1 to 10 or more functional groups can be appropriately selected. Examples of general crosslinking agents frequently used for urethane rubber include, but are not limited to: bifunctional compounds such as 1,3-propanediol (PD), 1,4-butanediol (BD), 2-methyl-1,5-pentanediol (MPD), 1,6-hexanediol (HD), dichlorodiaminodiphenylmethane (MOCA), and dimethylthiotoluenediamine (ETHACURE 300); trifunctional compounds such as glycerol and trimethylolpropane (TMP); tetrafunctional compounds such as pentaerythritol; and a high molecular weight polyol having several hundreds or more molecular weights obtained by polymerizing PPG or the like using these crosslinking agents as an initiator.

—Catalyst—

Also, a curing-accelerating catalyst can be added for controlling an urethanization reaction. Curing-accelerating catalysts are roughly classified into amine types and metal types, and a curing-accelerating catalyst can be easily handled in the production process by formulating and designing the curing-accelerating catalyst such that a liquid curing time (pot life) at room temperature is lengthened and thermal curing is quickly terminated under a high temperature environment. A catalyst suitable for this condition is an amine type catalyst to which an acid is added. For example, a grade characterized by temperature susceptibility such as U-CAT series manufactured by San-Apro Ltd. and TOYOCAT series manufactured by Tosoh Corporation are suitable.

—Flame Retardant—

A flame retardant is added to the elastic layer for ensuring flame retardancy. The flame retardant is not particularly limited, but it is preferable to add 2 or more types of flame retardants having different flame retardant mechanisms. Examples of the flame retardant include, but are not limited to, a halogen type having halogen atoms that generate a gas to block oxygen during combustion, a phosphate type that forms a carbonized layer, a hydrated metal compound that causes heat absorption by dehydration, and a nitrogen compound that generate nitrogen gas. Among them, the halogen type is unsuitable because of toxic gas generation, and therefore it is preferable to use the other flame retardants.

A proportion of the flame retardant added in the elastic layer is preferably 30% by mass or more to 80% by mass or less, more preferably 40% by mass or more to 60% by mass or less.

—Other Components—

Besides, the same electric resistance adjusting agent as for the base layer can be appropriately added for adjusting a volume resistance value and a surface resistance value of the elastic layer. Furthermore, inorganic fine particles such as silica can be added as a reinforcing agent.

When a raw material of the ether-based urethane rubber is liquid at room temperature, a particulate flame retardant or filler can be uniformly dispersed by screw mixing or the like without a large-scale apparatus. If required, a small amount of a dispersant such as a surfactant may be added. In addition, when the raw material is too viscous to uniformly disperse as a powder, the viscosity of the raw material is decreased by adding a required amount of organic solvent, to facilitate uniform dispersion.

The ether-based urethane rubber can be crosslinked by heating. The heating is carried out preferably 80 to 150° C. for about 30 minutes to 3 hours. As a heating method, a method used for crosslinking rubber, such as general oven heating or hot air heating may be appropriately selected.

Furthermore, for the purpose of deactivating unreacted isocyanate remaining after heating, "curing" operation under a high-temperature and high-humidity environment may be performed. For curing, a thermally cured rubber may be left to stand e.g. under an environment at a room temperature of 40° C. and a relative humidity of 85% for about 12 to 72 hours.

An average thickness of the elastic layer is preferably 200 μm or more to 600 μm or less, more preferably 300 μm or more to 500 μm or less. When the average thickness is 200 μm or more, an image quality for a paper type having an irregular surface is good, and when the average thickness is 600 μm or less, the elastic layer has an appropriate weight, flexure or warp are not caused, and running stability can be obtained.

The thickness of the elastic layer refers to a thickness of the elastic material for the elastic layer excluding the particles, and can be referred to as e.g. a thickness of the elastic material in a region without particles.

The average thickness is an average value obtained by measuring thicknesses at any 10 sites. Incidentally, the thickness can be measured by observing a cross section e.g. using a scanning electron microscope (SEM, manufactured by KEYENCE CORPORATION, apparatus name: VE-7800).

<Particle>

The particles used in the elastic layer are preferably spherical particles. Examples of the material for the spherical particles include, but are not particularly limited to, spherical particles mainly composed of a resin such as an acrylic resin, a melamine resin, a polyamide resin, a polyester resin, a silicone resin, and a fluororesin. In addition, particles made of these resin materials, of which the surfaces are treated with different type materials, may be used. In addition, the aforementioned resins include rubber materials. Spherical particles having a structure in which surfaces of the spherical particles made of a rubber material are coated with a hard resin can also be applied. The particles may be hollow or porous. Above all, the acrylic resin particles or the silicone resin particles are preferable as highly functional resins having lubricability and capable of providing toner releasability and wear resistance. Particles made of these resins and formed in a spherical shape by a polymerization method or the like are preferable, and in the present disclosure, the closer to true sphere the particles are, the more preferable the particles are.

A particle diameter of the spherical particles is preferably 5 μm or less, more preferably 1.0 to 5.0 μm in terms of a volume average particle diameter (hereinafter, simply referred to as an average particle diameter in some cases). The spherical particles are preferably monodispersed particles. The monodispersed particles described herein do not refer to particles having a single particle diameter but particles having a very sharp particle size distribution. Specifically, particles having a distribution width of an average particle diameter ±[average particle diameter×0.5] μm or less are allowed. When the volume average particle diameter is 1.0 μm or more, an effect of transfer performance can be sufficiently obtained by the particles. On the other hand, when the volume average particle diameter is 5.0 μm or less, a surface roughness and a gap between particles are not excessively increased, and therefore toner transfer and cleaning performance are improved.

Furthermore, since the spherical particles are often insulating, when the particle diameter is too large, there is a problem that a charged potential remains due to the particles, and thereby an image is disturbed due to storage of the remaining potential during continuous image output. Thus, the particle surfaces may be coated with a conductive polymer film or a metal-plated film.

An arrangement configuration of the spherical particles is not particularly limited and can be appropriately selected according to the intended purpose. Examples of the configuration include, but are not limited to, a configuration that particles are formed in a single layer in the thickness direction of the elastic layer, and a configuration that the layer contains a plurality of spherical particles in the thickness direction.

Above all, the configuration that the particles are formed in a single layer in the thickness direction of the elastic layer is preferable in that the spherical particles are directly applied on the elastic layer and leveled to facilitate uniform arrangement, so that a stable high quality image can be maintained.

The spherical particles are partially embedded in the elastic layer, and an embedment rate is preferably more than 50% and less than 100%, more preferably 51% or more to 90% or less. When the embedment rate is more than 50%, exfoliation of the spherical particles is suppressed even during long-term use in the image forming apparatus, and the durability is improved. On the other hand, when the embedment rate is less than 100%, the transfer performance is improved due to the presence of the spherical particles.

The embedment rate refers to a rate indicating how large a proportion of the spherical particle diameter is embedded in the thickness direction of the elastic layer, but the embedment rate described in this specification does not mean that the embedment rate of all spherical particles is more than 50% and less than 100%, and it is enough that a value of an average embedment rate in a certain view is more than 50% and less than 100%. However, when the embedment rate is 50%, almost particles are not completely embedded in the elastic layer in cross-sectional observation using an electron microscope. In the present disclosure, a rate of the spherical particles completely embedded in the elastic layer is preferably 5% by number or less of the whole spherical particles.

The embedment rate can be measured by a process that any sites of the elastic layer surface are observed using a scanning electron microscope (SEM, manufactured by KEYENCE CORPORATION, device name: VE-7800) in a cross-sectional SEM observation (5,000 magnifications) to calculate how large proportions of diameters of 10 spherical particles are embedded in the thickness direction of the elastic layer, and an average value of the proportions is calculated.

The shape of the spherical particles is preferably a true spherical particle from the viewpoint of the toner transfer rate.

The true spherical shape is defined as follows.

Figure 2:
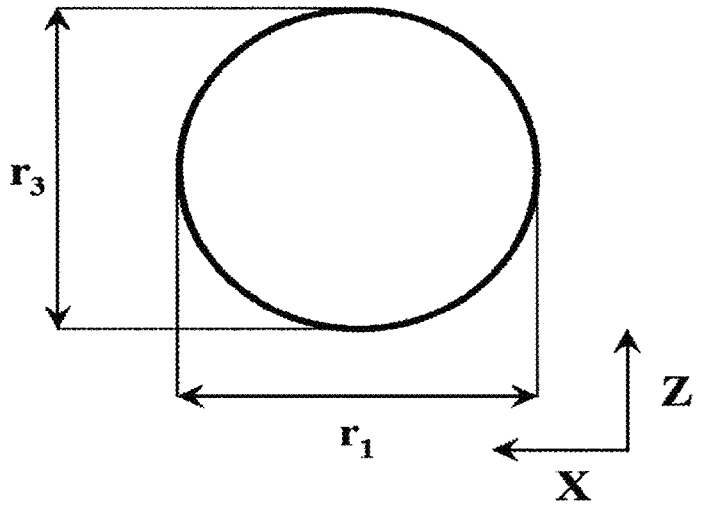
FIG. 2 is a schematic view illustrating the shape of the spherical particle.
Figure 3:
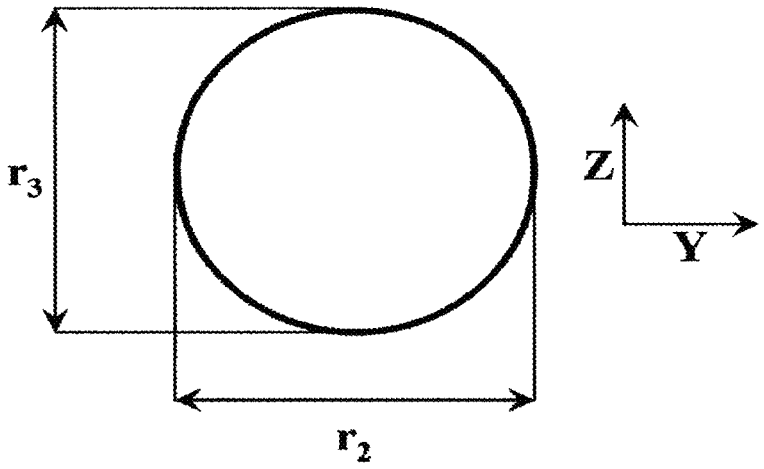
FIG. 3 is a schematic view illustrating the shape of the spherical particle.

FIG. 1 to FIG. 3 are schematic views illustrating a shape of the spherical particle used in the present disclosure.

In FIG. 1 to FIG. 3, under a condition that the spherical particle 3 is defined to have a major axis of r1, a minor axis of r2, and a thickness of r3 (with the proviso of r1≥r2≥r3), a spherical particle in which a ratio of the minor axis to the major axis (r2/r1) is within a range of 0.9 to 1.0 and a ratio of the thickness to the minor axis (r3/r2) is within a range of 0.9 to 1.0 is defined as a true spherical particle.

When the ratio of the minor axis to the major axis (r2/r1) and the ratio of the thickness to the minor axis (r3/r2) are 0.9 or more, the spherical particles are easily arranged on the surface of the elastic layer, and the toner transfer rate is improved.

The major axis r1, the minor axis r2, and the thickness r3 can be determined e.g. by a process that spherical particles are uniformly dispersed and stuck on a smooth measurement face, and major axes r1 (μm), minor axes r2 (μm), and thicknesses r3 (μm) of 100 spherical particles are measured using a color laser microscope "VK-8500" (manufactured by KEYENCE CORPORATION) with any magnifications (e.g. 1,000 magnifications), and their arithmetic average values are calculated.

Figure 4:
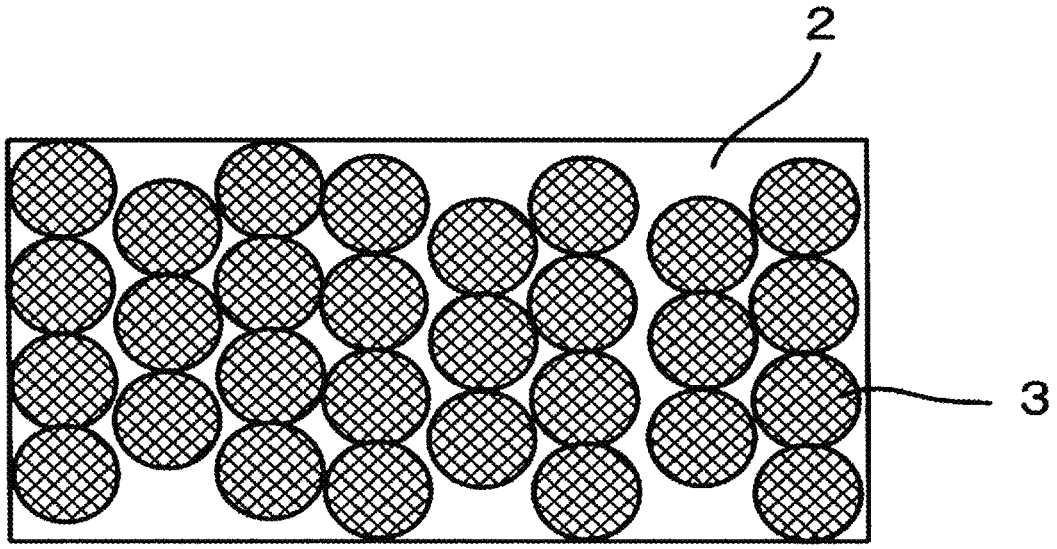
FIG. 4 is an enlarged schematic view illustrating a surface of an intermediate transfer belt observed from above.

Herein, FIG. 4 is an enlarged schematic view illustrating the surface of the intermediate transfer belt observed from above. As illustrated in the figure, it is preferable that the spherical particles 3 having a uniform particle diameter are independently and orderly arranged on the surface of the elastic layer 2, and overlapping among the spherical particles 3 is hardly observed. Also the cross-sectional diameter at the elastic layer face of each spherical particle 3 constituting the surface of the intermediate transfer belt is preferably uniform, and specifically, a distribution width of the diameter is preferably ±[average particle diameter×0.5] μm or less.

Incidentally, if a technique capable of limiting the overlapping among the spherical particles 3 as illustrated in FIG. 4 can be used, the particle diameters of the spherical particles 3 do not necessarily satisfy the aforementioned distribution width.

Preferably, the spherical particles 3 occupy 60% or more of the surface area of the elastic layer 2. When such an occupied area rate is satisfied, a portion of the ether-based urethane rubber is appropriately exposed, and a preferable transferability can be obtained. The occupied area rate is more preferably 80% or more.

In addition, according to an embodiment of the present invention, the elastic layer has a flame retardancy of VTM-1 or higher in the UL94-VTM test.

In the UL94-VTM test (vertical burning test for thin materials), a film test piece (200±5×50±1×t mm) is rolled in a cylindrical shape and perpendicularly attached to the clamp, subjected to flame contact with 20-mm flame for 3 seconds twice, and Judged to VTM-0, VTM-1, VTM-2, or NOT depending on the combustion behavior.

The flame retardancy is expressed as Good: VTM-0 (V-0)>VTM-1 (V-1)>VTM-2 (V-2)>NOT: Incompatible. Table 1 presents criteria.

TABLE 1

| Criteria | Classification of combustibility | | | |
|---|---|---|---|---|
| | VTM-0 | VTM-1 | VTM-2 | NOT |
| Combustion time of each test piece | 10 seconds or less | 30 seconds or less | 30 seconds or less | Incompatible |
| Total combustion time of five test pieces | 50 seconds or less | 250 seconds or less | 250 seconds or less | |
| Combustion + glowing time of each test piece | 30 seconds or less | 60 seconds or less | 60 seconds or less | |
| Time for reaching clamp | NOT | NOT | NOT | |
| Cotton ignition by drops | NOT | NOT | ANY | |

<Method for Producing Intermediate Transfer Belt>

An example of a method for producing the intermediate transfer belt according to an embodiment of the present invention will be explained. First, a method for producing a base layer will be explained.

The base layer can be formed using a base layer coating liquid containing at least a resin component, e.g. a base layer coating liquid containing a polyimide resin precursor or a polyamideimide resin precursor.

While a cylindrical die e.g. a cylindrical metal die is slowly rotated, a coating liquid containing at least a resin component (e.g. a coating liquid containing a polyimide resin precursor or a polyamideimide resin precursor) is uniformly applied and cast (to form a coating film) on the whole outer surface of the cylinder using a liquid feeding apparatus such as a nozzle and a dispenser. Subsequently, the rotational speed is increased to a predetermined speed, and once the speed reaches the predetermined speed, the rotation is continued while maintaining a constant rotational speed for a desired time. Then, while rotating the die and gradually increasing the temperature, the solvent in the coating film is evaporated at 80° C. or more to 150° C. or less. In this process, it is preferable that vapor (volatilized solvent and the like) in atmosphere is efficiently circulated to remove the solvent. Once a self-supporting film is formed, the coating film together with the die is transferred to a heating furnace (baking furnace) capable of high-temperature treatment, gradually heated, and finally heat-treated (baked) at a high temperature of 250° C. or more to 450° C. or less to sufficiently imidize or polyamideimidize the polyimide resin precursor or the polyamideimide resin precursor respectively. The coating film is sufficiently cooled, on which subsequently an elastic layer is laminated.

The elastic layer can be produced by a process that a paint obtained by uniformly dispersing a flame retardant in an ether-based urethane rubber raw material is applied on the base layer, and subsequently, if using a solvent, the solvent is dried, and the paint is vulcanized by heating. As the applying method, existing coating methods such as a spiral coating, a die coating, and a roll coating can be applied in the same way as for the base layer, but the thickness of the elastic layer should be increased for improving the irregular transferability. As a coating method of forming a thick film, the die coating and the spiral coating are excellent. Herein, the spiral coating will be explained. First, while rotating the base layer in a circumferential direction, a rubber paint is continuously fed using a round or wide nozzle, meanwhile the nozzle is moved in the axial direction of the base layer, and the paint is spirally applied on the base layer. The paint spirally applied on the base layer is dried while being leveled by maintaining a predetermined rotational speed and a drying temperature. Subsequently, the paint is further vulcanized (crosslinked) at a predetermined vulcanization temperature to form the elastic layer.

Then, the vulcanized elastic layer is sufficiently cooled, and subsequently a particle layer is formed by applying the particles on the elastic layer, to obtain a desired seamless belt (intermediate transfer belt).

Figure 5:
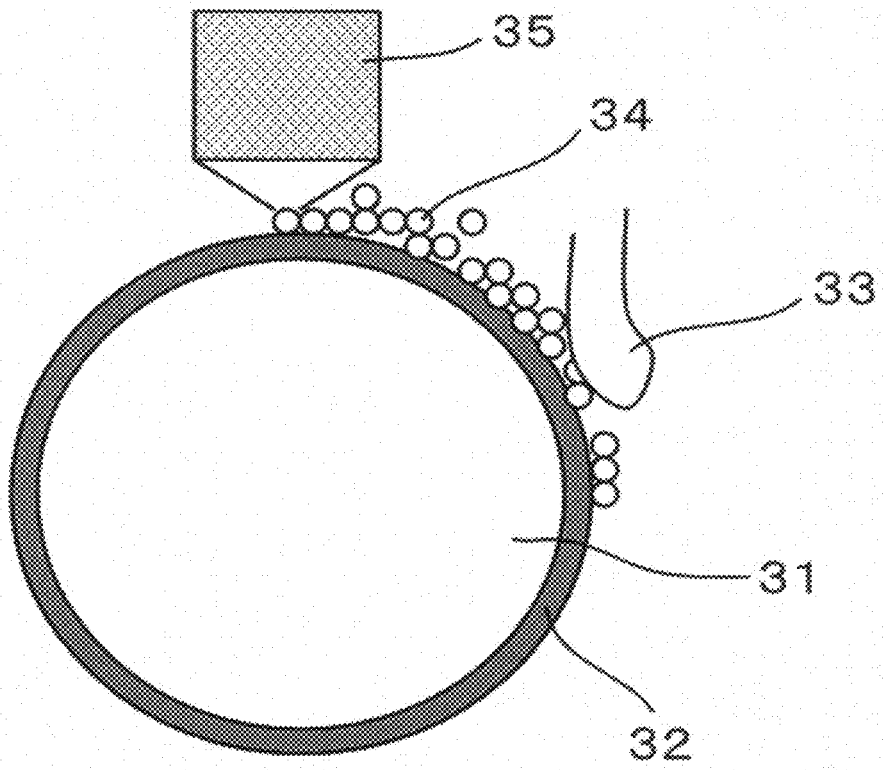
FIG. 5 is a schematic view illustrating an example of a method for applying the spherical particles to an elastic layer.

Herein, in a method of forming the particle layer, as illustrated in FIG. 5, a powder feeding apparatus 35 and a pressing member 33 are installed, and a belt 32 coated with the base layer and the elastic layer are attached to a die drum 31. Spherical particles 34 are uniformly dispersed on a surface of the elastic layer from the powder feeding apparatus 35 while rotating the die drum 31, and the spherical particles 34 dispersed on the surface are pressed at a constant pressure by the pressing member 33.

The pressing member 33 embeds the particles in the elastic layer and removes excess particles. In the present disclosure, in particular using monodispersed particles, the spherical particles 34 can be independently embedded in a monoparticle state in the thickness direction of the elastic layer (preferably also in the plane direction) by a simple process including nothing but such a leveling process with the pressing member. Thereby, an irregular shape can be formed on the surface of the elastic layer. The embedment rate is adjusted depending on a pressing time of the pressing member in this process.

The adjustment of the embedment rate of the particles in the elastic layer is not particularly limited, and can be appropriately selected depending on the intended purpose. For example, the embedment rate can be easily adjusted by adjusting the pressing force of the pressing member. For example, depending on a viscosity and a solid content of a casting coating liquid, an usage amount of a solvent, a material of particles, and the like, an embedment rate of more than 50% and less than 100% can be relatively easily achieved under a condition that, as standards, the pressing force is within a range of 1 to 1,000 mN/cm when the viscosity of the casted coating liquid is 100 mPa·s or more to 100,000 mPa·s or less.

The particles are uniformly arranged on the surface of the elastic layer, then heated while rotating at a predetermined temperature for a predetermined time to form an elastic layer in which the cured particles are embedded. The elastic layer is sufficiently cooled, and then removed together with the base layer from the die to obtain a desired seamless belt (intermediate transfer belt).

From the viewpoint of improving the effect of the present disclosure, the intermediate transfer belt preferably has a Martens hardness of 0.3 to 0.6 $N/mm^2$ and an elastic power of 60% to 85%. The Martens hardness and the elastic power can be measured e.g. using FISCHERS COPE HM-2000 manufactured by FISCHER INSTRUMENTS K.K. in accordance with the following method.

Test temperature: 23° C., 50% RH

Indenter: Diamond flat indenter with a diameter of 50 μm

Load increase rate: 40 mN/10 seconds

Creep: 10 seconds

Load decrease: 10 seconds

Incidentally, the Martens hardness is more preferably 0.30 to 0.45 $N/mm^2$, and the elastic power is more preferably 70% to 85%.

A resistance of the intermediate transfer belt produced as described above is adjusted by changing amounts of the carbon black and the ion conductive agent. At this time, attention should be paid because the resistance tends to change depending on the size and the occupied area rate of the particles.

The resistance value of the intermediate transfer belt is preferably $1\times10^8$ Ω/square or more to $1\times10^{13}$ Ω/square or less in terms of surface resistance, and is preferably $1\times10^8$ Ω·cm or more to $1\times10^{11}$ Ω·cm or less in terms of volume resistance.

For measuring the resistances, a commercially available meter can be used, and e.g. Hiresta manufactured by Dia Instruments Co., Ltd. can be used for the measurement.

Figure 6:
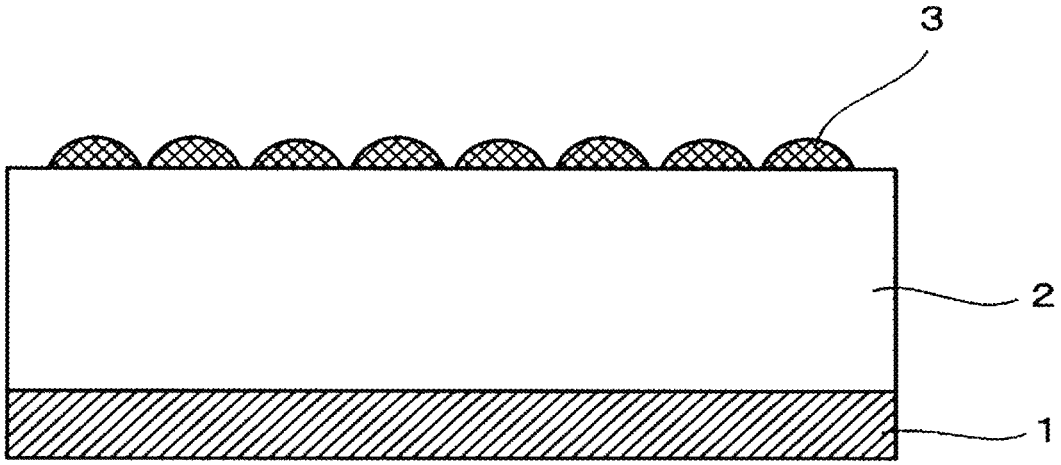
FIG. 6 is a schematic view illustrating an example of a layer constitution of an intermediate transfer belt according to an embodiment of the present invention.

Herein, FIG. 6 is a schematic view illustrating an example of the layer constitution of the intermediate transfer belt according to an embodiment of the present invention. In the intermediate transfer belt illustrated in FIG. 6, a flexible elastic layer 2 is laminated on a rigid base layer 1 that is relatively flexible, and particles 3 are independently arranged (embedded) in a surface direction on the outermost surface of the elastic layer 2, so that the elastic layer 2 having a uniform irregular shape is laminated. When the particles 3 are in a monoparticle state, there is almost no overlapping among the particles in the layer thickness direction and there is almost no complete embedment of the particles 3 in the elastic layer 2.

The intermediate transfer belt is preferably an endless belt, i.e. a seamless belt. When the intermediate transfer belt is the endless belt, a circumferential length of the intermediate transfer belt is not particularly limited and can be appropriately selected depending on the intended purpose, but is preferably 1,000 mm or more, more preferably 1,100 mm or more to 3,000 mm or less.

The intermediate transfer belt according to an embodiment of the present invention is suitably used for an apparatus in a style that a plurality of color toner developed images sequentially formed on an image bearer (e.g. a photoconductor drum) of an intermediate transfer belt type image forming apparatus are sequentially superposed on the intermediate transfer belt and primarily transferred, and the obtained primary transfer images are secondarily and collectively transferred onto a recording medium.

(Image Forming Apparatus and Image Forming Method)

The image forming apparatus according to an embodiment of the present invention has an image bearer on which a latent image is formed, capable of carrying a toner image, a development device containing a toner, configured to develop the latent image formed on the image bearer with the toner to form the toner image, an intermediate transfer belt onto which the toner image developed by the development device is primarily transferred, a transfer device configured to secondarily transfer the toner image carried on the intermediate transfer belt onto a recording medium, and optionally other devices appropriately selected.

The intermediate transfer belt is the intermediate transfer belt according to an embodiment of the present invention.

In this case, it is preferable that the image forming apparatus is a full color image forming apparatus including a plurality of pairs of the image bearer and the development device, in which the image bearers are arranged in series and the development devices respectively contain different color toners.

The image forming method according to an embodiment of the present invention includes developing, with a toner, a latent image formed on an image bearer capable of carrying a toner image to form the toner image, primarily transferring the toner image developed in the developing onto an intermediate transfer belt, a secondarily transferring the toner image carried on the intermediate transfer belt onto a recording medium, and optionally other steps.

The intermediate transfer belt is the intermediate transfer belt according to an embodiment of the present invention.

Hereinafter, the seamless belt used in the belt constituent portion installed on the image forming apparatus will be explained in detail with reference to a main portion schematic diagram. The schematic diagram is merely an example, and the present invention is not limited to this diagram.

Figure 7:
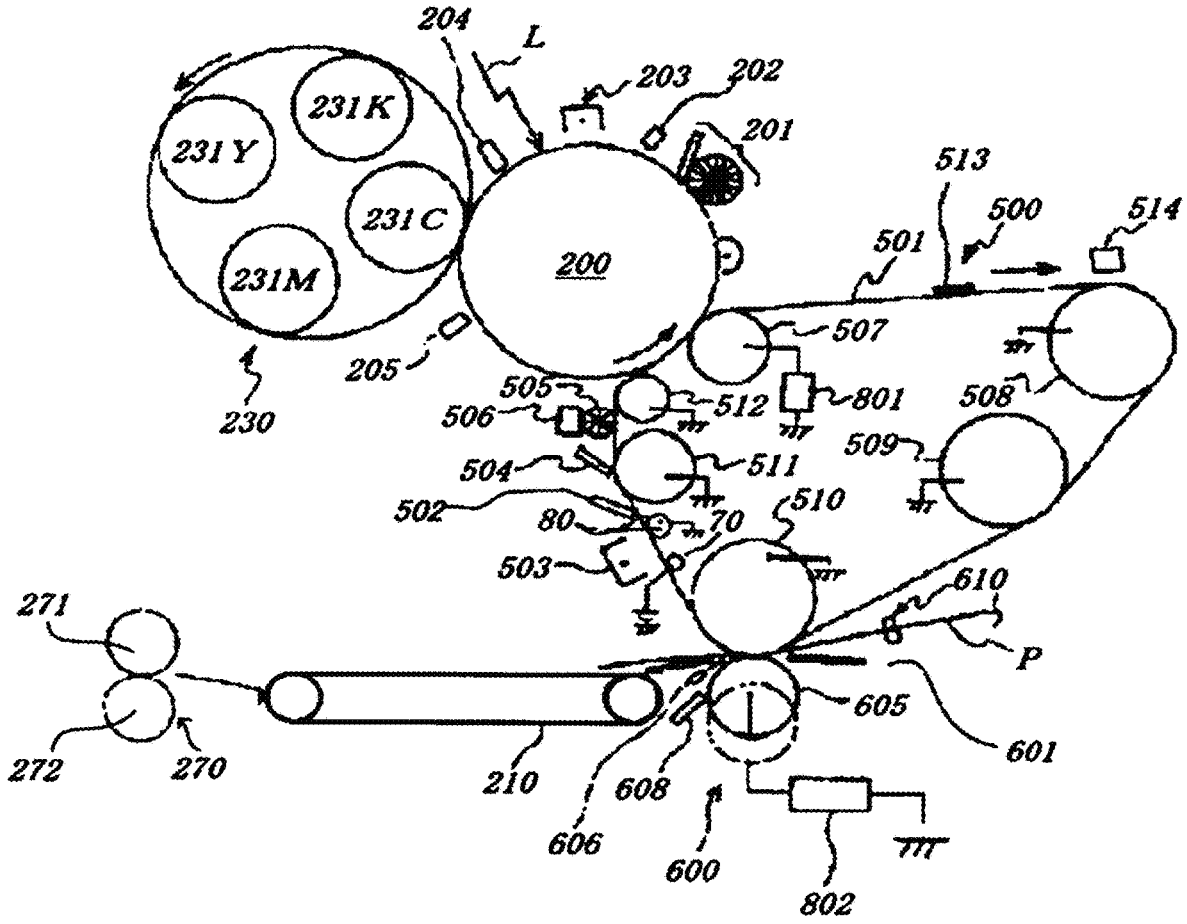
FIG. 7 is a main portion schematic diagram illustrating an example of an image forming apparatus according to an embodiment of the present invention.

FIG. 7 is a main portion schematic diagram for explaining the image forming apparatus equipped with the seamless belt obtained by the production method according to the present invention as a belt member.

An intermediate transfer unit 500 including the belt member illustrated in FIG. 7 is composed of an intermediate transfer belt 501 that is an intermediate transferer stretched by a plurality of rollers, and the like. Around the intermediate transfer belt 501, a secondary transfer bias roller 605 that is a secondary transfer charge applying device of a secondary transfer unit 600, a belt cleaning blade 504 that is an intermediate transferer cleaning device, and a lubricant applying brush 505 that is a lubricant applying member of a lubricant applying device, and the like are disposed so as to be opposite to the intermediate transfer belt 501.

A position detecting mark is disposed on an outer peripheral face or an inner peripheral face of the intermediate transfer belt 501. However, on the outer peripheral face side of the intermediate transfer belt 501, it is required to apply a devise to dispose the position detecting mark away from a passing area of the belt cleaning blade 504, which may be accompanied by difficulty in arrangement. Thus, in that case, a position detecting mark may be disposed on the inner peripheral face side of the intermediate transfer belt 501. An optical sensor 514 as a mark detecting sensor is disposed between a primary transfer bias roller 507 and a belt driving roller 508 between which the intermediate transfer belt 501 is bridged.

The intermediate transfer belt 501 is stretched by the primary transfer bias roller 507 as the primary transfer charge applying device, the belt driving roller 508, a belt tension roller 509, a secondary transfer counter roller 510, a cleaning counter roller 511, and a feedback current detecting roller 512. Each roller is formed of a conductive material, and each roller other than the primary transfer bias roller 507 is grounded. A transfer bias controlled to a predetermined current or voltage depending on the number of superposed toner images is applied to the primary transfer bias roller 507 by a primary transfer power supply 801 controlled to a constant current or a constant voltage.

The intermediate transfer belt 501 is driven in an arrow direction by the belt driving roller 508 that is rotationally driven in the arrow direction by a drive motor.

This intermediate transfer belt 501 as the belt member is normally made of a semiconductor or an insulator and has a single-layer or multi-layer structure. In the present disclosure, a seamless belt is preferably used, to make it possible to improve durability and form an excellent image. In addition, the intermediate transfer belt is set to be larger than the maximum paper-passable size for superposing toner images formed on a photoconductor drum 200.

The secondary transfer bias roller 605 as a secondary transfer device is configured to be attachable to or detachable from a portion stretched by the secondary transfer counter roller 510 on the outer peripheral face of the intermediate transfer belt 501 by an attachment/detachment mechanism as an attachment/detachment device described later. The secondary transfer bias roller 605 is disposed so as to sandwich a transfer paper P as a recording medium between the portion stretched by the secondary transfer counter roller 510 on the intermediate transfer belt 501 and the secondary transfer bias roller 605. A transfer bias having a predetermined current is applied to the secondary transfer bias roller 605 by a secondary transfer power supply 802 controlled to a constant current.

A registration roller 610 feeds the transfer paper P as a transfer material between the secondary transfer bias roller 605 and the intermediate transfer belt 501 stretched by the secondary transfer counter roller 510 at a predetermined timing. In addition, a cleaning blade 608 as a cleaning device is in contact with the secondary transfer bias roller 605. The cleaning blade 608 removes deposits adhering to the surface of the secondary transfer bias roller 605 for cleaning.

In the color copying machine having such a configuration, once an image forming cycle is started, the photoconductor drum 200 is rotated counterclockwise as indicated by the arrow by a drive motor to form a black (Bk) toner image, a cyan (C) toner image, a magenta (M) toner image, and a yellow (Y) toner image on the photoconductor drum 200. The intermediate transfer belt 501 is rotated clockwise as indicated by the arrow by the belt driving roller 508. Accompanying this rotation of the intermediate transfer belt 501, the Bk toner image, the C toner image, the M toner image, and the Y toner image are primarily transferred by the transfer bias due to the voltage applied to the primary transfer bias roller 507, and finally, each toner image is superposed on the intermediate transfer belt 501 in an order of Bk, C, M, and Y.

For example, the Bk toner image is formed as follows.

In FIG. 7, an electrostatic charger 203 applies a uniform negative charge to the surface of the photoconductor drum 200 at a predetermined potential by corona discharge. The timing is determined on the basis of a belt mark detecting signal, and raster exposure with a laser light is performed on the basis of a Bk color image signal by a writing optical unit. Once this raster image is exposed, the exposed portion on the surface of the photoconductor drum 200 that is initially uniformly charged loses the charge proportional to the exposure light quantity, so that a Bk electrostatic latent image is formed. When the negatively-charged Bk toner on a development roller of a Bk development equipment 231K comes into contact with this Bk electrostatic latent image, the toner does not adhere to a portion having the remaining charge but adheres to a portion without the charge i.e. an exposed portion, on the photoconductor drum 200, so that a Bk toner image similar to the electrostatic latent image is formed.

The Bk toner image formed on the photosensitive drum 200 as described above is primarily transferred onto the outer peripheral face of the intermediate transfer belt 501 under constant-speed driving rotation in contact with the photoconductor drum 200. A small amount of untransferred residual toner remaining on the surface of the photoconductor drum 200 after this primary transfer is cleaned off by a photoconductor cleaning apparatus 201 in preparation for reuse of the photoconductor drum 200. On the side of the photoconductor drum 200, the process proceeds from the Bk image forming step to the C image forming step, and reading of C image data by the color scanner starts at a predetermined timing. Laser light writing based on the C image data forms a C electrostatic latent image on the surface of the photoconductor drum 200.

Then, between passage of a rear end portion of the aforementioned Bk electrostatic latent image and arrival of a front end portion of the C electrostatic latent image, a revolver development unit 230 is rotated, a C developing machine 231C is set on a development position, and the C electrostatic latent image is developed with the C toner. Thereafter, the development of the C electrostatic latent image area is continued, but at a time when a rear end portion of the C electrostatic latent image passes, the revolver development unit is rotated in the same manner as in the case of the aforementioned Bk developing machine 231K, and a subsequent M developing machine 231M is moved to the development position. Also, this step is completed before a front end portion of the subsequent Y electrostatic latent image reaches the development position. Note that explanation of the M and Y image forming steps are omitted because the respective operations of color image data reading, electrostatic latent image formation, and development are the same as in the aforementioned steps for the Bk and C.

The Bk, C, M, and Y toner images sequentially formed on the photoconductor drum 200 as described above are sequentially aligned on the same surface of the intermediate transfer belt 501, and primarily transferred. Thereby, a toner image on which up to four colors are superposed is formed on the intermediate transfer belt 501. On the other hand, at the time when the image forming operation is started, the transfer paper P is fed from a paper feeding portion such as a transfer paper cassette or a manual insertion tray, and is in a standby state on a nip of the registration roller 610.

When the front end of the toner image on the intermediate transfer belt 501 reaches a secondary transfer portion having the nip by the intermediate transfer belt 501 stretched by the secondary transfer counter roller 510 and the secondary transfer bias roller 605, the registration roller 610 is driven such that the front end of the transfer paper P coincides with the front end of the toner image. Then the transfer paper P is conveyed along a transfer paper guide plate 601, and registration between the transfer paper P and the toner image is carried out.

As described above, when the transfer sheet P passes over the secondary transfer portion, the four-color superposed toner image on the intermediate transfer belt 501 is collectively transferred on the transfer paper P (secondary transfer) by the transfer bias based on a voltage applied on the secondary transfer bias roller 605 by the secondary transfer power supply 802. This transfer paper P is conveyed along the transfer paper guide plate 601, and passes over an opposite portion to a transfer paper destaticizing charger 606 including a destaticization needle disposed downstream of the secondary transfer portion, so that the transfer paper P is destaticized. Then the transfer paper P is conveyed to a fixation apparatus 270 by a belt conveyer 210 as a belt constituent portion. After the toner image is melted and fixed by nip portions of fixation rollers 271 and 272 of the fixation apparatus 270, this transfer paper P is sent out of the apparatus body by an ejection roller, and stacked with face up on a copy tray. Incidentally, the fixation apparatus 270 can also be configured to include the belt constituent portion, as required.

On the other hand, the surface of the photoconductor drum 200 after the belt transfer is cleaned by the photoconductor cleaning apparatus 201 and uniformly destaticized by a destaticization lamp 202. Also, after the toner image is secondarily transferred to the transfer paper P, the residual toner remaining on the outer peripheral face of the intermediate transfer belt 501 is cleaned off by the belt cleaning blade 504. The belt cleaning blade 504 is configured to be attachable to or detachable from the outer peripheral face of the intermediate transfer belt 501 at a predetermined timing by a cleaning member attachment/detachment mechanism.

A toner seal member 502 attachable to or detachable from the outer peripheral face of the intermediate transfer belt 501 is disposed upstream of this belt cleaning blade 504 in the moving direction of the intermediate transfer belt 501. This toner seal member 502 receives the toner falling from the belt cleaning blade 504 during cleaning of the residual toner to prevent the falling toner from scattering on a route for conveying the transfer paper P. This toner seal member 502 is attached to or detached from the outer peripheral face of the intermediate transfer belt 501 together with the belt cleaning blade 504 by the cleaning member attachment/detachment mechanism.

On the outer peripheral face of the intermediate transfer belt 501 from which the residual toner has been removed as described above, a lubricant 506 scraped by the lubricant applying brush 505 is applied. The lubricant 506 is made of e.g. a solid substance such as zinc stearate, and is disposed in contact with the lubricant applying brush 505. In addition, the residual charge remaining on the outer peripheral face of the intermediate transfer belt 501 is removed by a destaticization bias applied by a belt neutralizing brush and in contact with the outer peripheral face of the intermediate transfer belt 501. Herein, the lubricant applying brush 505 and the belt destaticizing brush are attached to or detached from the outer peripheral face of the intermediate transfer belt 501 at a predetermined timing by each of their attachment/detachment mechanisms.

Herein, when copying is repeated, in operation of a color scanner and image formation on the photoconductor drum 200, the image for the fourth color (Y) of the first paper is formed, and subsequently, at a predetermined timing, the image for the first color (Bk) of the second paper is formed. In addition, the intermediate transfer belt 501 is configured such that, after the step of collectively transferring the first four-color superposed toner image on the transfer paper, the second Bk toner image is primarily transferred to an area of the outer peripheral face of the intermediate transfer belt 501, cleaned by the belt cleaning blade 504. After that, the operation is the same as for the first paper. This process is in a copy mode for obtaining a full-color copy of four colors. In the case of a three-color copy mode or a two-color copy mode, the same operation is performed with designated colors and a number of papers. In a case of a single color copy mode, nothing but the development machine for a predetermined color in the revolver development unit 230 is in the developing operation state until a predetermined number of paper sheets are completely printed, and copying operation is performed such that the belt cleaning blade 504 is in contact with the intermediate transfer belt 501.

Referring to FIG. 7, 70 denotes destaticization roller, 80 denotes a ground roller, 204 denotes a potential sensor, 205 denotes an image density sensor, 503 denotes a charger, 513 denotes a toner image, and L denotes laser light.

Figure 8:
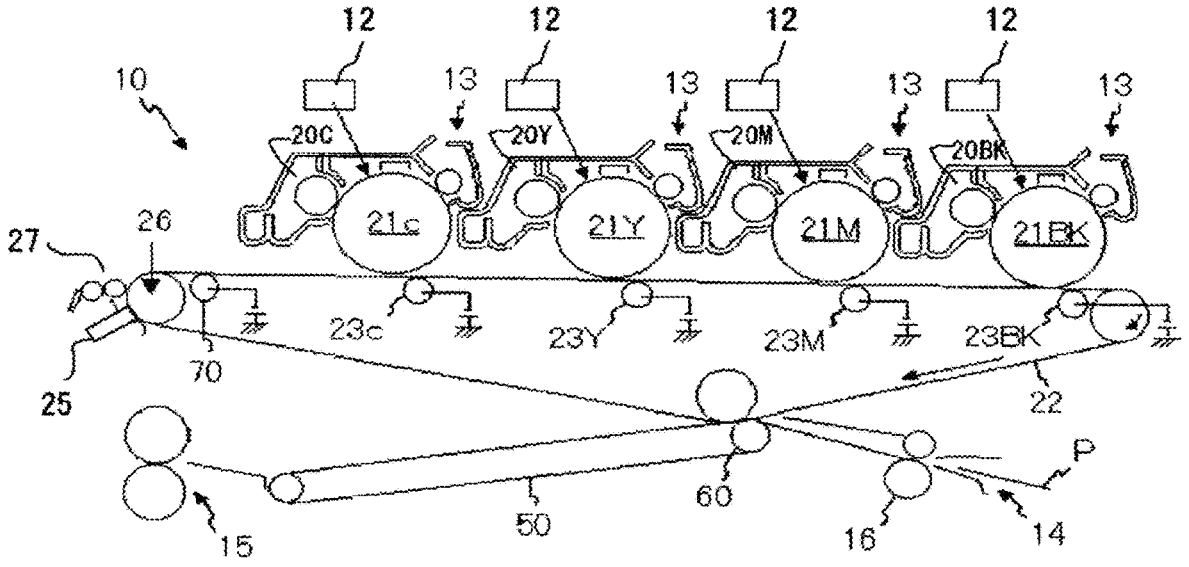
FIG. 8 is a main portion schematic diagram illustrating another example of the image forming apparatus according to an embodiment of the present invention.

Although the copying machine including one photoconductor drum alone has been explained in the aforementioned embodiment, the present invention can also be applied to e.g. an image forming apparatus in which a plurality of photoconductor drums are juxtaposed along one intermediate transfer belt including a seamless belt as illustrated as one configuration example in the main portion schematic diagram of FIG. 8.

FIG. 8 illustrates one configuration example of a four-drum type digital color printer including four photoconductor drums 21Bk, 21M, 21Y, and 21C for forming toner images of four different colors (black, magenta, yellow, and cyan).

In FIG. 8, a printer body 10 includes image writing units 12, image forming units 13, and a paper feeding unit 14 for forming a color image on the basis of an electrophotographic method. On the basis of image signals, an image is processed in an image processing portion to convert the image into each color signal, black (Bk), magenta (M), yellow (Y), and cyan (C), which are transmitted to the image writing units 12. Each of the image writing units 12 is e.g. a laser scanning optical system including a laser light source, a deflector such as a rotating polygon mirror, a scanning image formation optical system, and a group of mirrors. The image writing units 12 have four writing optical paths corresponding to each color signal, and write images corresponding to each color signal on image bearers (photoconductors) 21BK, 21M, 21Y, and 21C disposed for each color of the image forming units 13.

The image forming units 13 include photoconductors 21Bk, 21M, 21Y, and 21C that are image bearers for black (Bk), magenta (M), yellow (Y), and cyan (C) respectively. As each photoconductor for each color, an OPC photoconductor is normally used. A charging apparatus, an exposure portion of laser light from the writing unit 12, a development apparatus 20Bk, 20M, 20Y, or 20C for each color, black, magenta, yellow, or cyan, a primary transfer bias roller 23Bk, 23M, 23Y, or 23C as a primary transfer device, a cleaning apparatus, and a photoconductor destaticizing apparatus, are disposed around each photoconductor 21Bk, 21M, 21Y, or 21C. Incidentally, a two-component magnetic brush developing method is used for the development apparatuses 20Bk, 20M, 20Y, and 20C. An intermediate transfer belt 22 as a belt constituent portion is disposed between each of the photoconductor 21Bk, 21M, 21Y, and 21C and each of the primary transfer bias rollers 23Bk, 23M, 23Y, and 23C respectively, and toner images of each color formed on each photoconductor are sequentially superposed and transferred.

On the other hand, the transfer paper P is fed from the paper feeding unit 14, then carried by a transfer conveyance belt 50 as a belt constituent portion via a registration roller 16. Then, at a position where the intermediate transfer belt 22 comes into contact with the transfer conveyance belt 50, the toner image transferred on the intermediate transfer belt 22 is secondarily transferred (batch transfer) by a secondary transfer bias roller 60 as a secondary transfer device. Thereby, a color image is formed on the transfer paper P. The transfer paper P on which this color image is formed is conveyed to a fixation apparatus 15 by the transfer conveyance belt 50, the transferred image is fixed by this fixation apparatus 15, and then the transfer paper P is ejected out of the printer body.

The residual toner that has not been transferred during the secondary transfer and remains on the intermediate transfer belt 22, is removed from the intermediate transfer belt 22 by a belt cleaning member 25. A lubricant application apparatus 27 is disposed downstream of the belt cleaning member 25. This lubricant application apparatus 27 includes a solid lubricant, and a conductive brush for rubbing and applying a solid lubricant onto the intermediate transfer belt 22. The conductive brush is constantly in constant with the intermediate transfer belt 22 to apply the solid lubricant on the intermediate transfer belt 22. The solid lubricant has effects of enhancing a cleaning performance of the intermediate transfer belt 22 and preventing occurrence of filming to improve durability.

In FIG. 8, 26 denotes a driving roller and 70 denotes a ground roller.

EXAMPLES

Hereinafter, examples of the present invention will be explained, however the present invention is not limited to these examples at all. Note that "parts" in the following examples means "parts by mass".

Example 1

<Preparation of Intermediate Transfer Belt>

—Preparation of Base Layer Coating Liquid—

First, a liquid dispersion of carbon black (trade name: Special Black 4, manufactured by Evonik Degussa GmbH) which had been previously dispersed in N-methyl-2-pyrrolidone by a bead mill was blended in a polyimide varnish (trade name: U-varnish A, manufactured by Ube Industries, Ltd.) containing a polyimide resin precursor as a main ingredient such that a carbon black content was 17% by mass based on a solid content of the polyamic acid, and thoroughly stirred and mixed to prepare a base layer coating liquid.

—Preparation of Polyimide Base Layer Belt—

Next, as a die, a metal cylindrical support with an outer diameter of 500 mm and a length of 400 mm, having an outer face roughened by blasting was attached to a roll coat coating apparatus.

Subsequently, the base layer coating liquid was poured into a pan, and drawn up with a application roller rotational speed of 40 mm/sec, and a gap between a regulation roller and the application roller was adjusted to 0.6 mm to control a thickness of the base layer coating liquid on the application roller.

Subsequently, the rotational speed of the cylindrical support was controlled to 35 mm/sec, the cylindrical support was brought near to the application roller, and a gap between the cylindrical support and the application roller was adjusted to 0.4 mm, the base layer coating liquid on the application roller was uniformly transferred and applied on the cylindrical support. Then, the cylindrical support was subjected to a hot air circulating dryer while maintaining the rotation, the temperature was gradually increased to 110° C., heating was continued for 30 minutes, furthermore the temperature was increased to 200° C., heating was continued for 30 minutes, and then the rotation was terminated.

After that, the cylindrical support was introduced into a heating furnace (baking furnace) capable of high-temperature treatment, the temperature was gradually increased to 320° C., and heating (baking) was continued for 60 minutes. The cylindrical support was sufficiently cooled to prepare a polyimide base layer belt having an average thickness of 60 μm.

—Preparation of Elastic Layer on Polyimide Base Layer Belt—

Respective components described below were blended at respective contents, mixed with a screw for 5 minutes, and then defoamed in a vacuum dryer to obtain a paint.

- Prepolymer CORONATE 4095 (Tosoh Corporation): 100 parts
- Phosphate-based flame retardant EXOLIT OP550 (CLARIANT CHEMICALS K.K.): 30 parts
- Metal hydroxide-based flame retardant BF013 (Nippon Light Metal Co., Ltd.): 50 parts
- Catalyst SA-1 (San-Apro Ltd.): 0.3 parts Subsequently, while rotating the cylindrical support on which the previously prepared polyimide base layer was formed, the paint was spirally applied on the polyimide base layer in such a way that the paint is moved in the axial direction of the cylindrical support while continuously discharging the paint from a nozzle. As a condition about the application quantity, the final average thickness of the elastic layer is 400 μm. Then, the cylindrical support coated with the paint was put into a hot air circulating drier while rotating the cylindrical support as it was, and heated at 120° C. for 100 minutes.

—Application of Particle on Elastic Layer Surface—

Next, the cylindrical support was taken out from the hot air circulating dryer and cooled, then TOSPEARL 120 (Momentive Performance Materials Inc.) that was a silicone true spherical particle having an average particle diameter of 2 μm was uniformly dispersed on the surface of the elastic layer as illustrated in FIG. 5, and fixed on the elastic layer surface by pressing the pressing member 33 including a polyurethane rubber blade (T7050, manufactured by Toyo Tire & Rubber Co., Ltd.) at a pressing force of 100 mN/cm.

Subsequently, the cylindrical support was put into the hot air circulation dryer again, and furthermore heated at 120° C. for 60 minutes to prepare an intermediate transfer belt A. Incidentally, EPOSTAR M30 is a benzoguanamine-melamine-formaldehyde condensate particle having an average particle diameter of 3 μm (NIPPON SHOKUBAI CO., LTD.).

In the same manner as described above except that the materials were changed, the intermediate transfer belts B to J in Examples 2 to 10 and the intermediate transfer belts K to O in Comparative Examples 1 to 5 were prepared as presented in Tables 2 and 3.

<UL94-VTM Test of Elastic Layer, Martens Hardness and Elastic Power of Intermediate Transfer Belt>

In the same manner as described above, UL94-VTM test of the elastic layer was conducted, and Martens hardnesses and elastic powers of the prepared intermediate transfer belts A to O were measured.

<Embedment Rate of Spherical Particle>

An embedment rate (%) of the spherical particles was measured in accordance with the aforementioned method.

Subsequently, the intermediate transfer belts A to O were evaluated for characteristics as intermediate transfer belts, as described below.

<Evaluation of Transferability>

Each of the intermediate transfer belts A to O was mounted on an image forming apparatus (RICOH, MP C6502, manufactured by Ricoh Co., Ltd.) as illustrated in FIG. 8. LEATHAC papers (LEATHAC 66, ream weight of 215 kg, manufactured by Takeo Co., Ltd.) were fed through each image forming apparatus under a condition of A4 size vertical output, 23° C., and 55% RH environment, to obtain 100,000 black halftone images.

Subsequently, 10 black halftone images were output with the A3 size LEATHAC papers, and all 10 images were checked for the presence of longitudinal streak images and transferability, and evaluated based on the following criteria.

[Evaluation Criteria]

Excellent: No longitudinal streak image on all 10 images (very good transferability and durability)

Good: Some slight longitudinal streaks on one or more or two or less images (good transferability and durability)

Medium: Slight longitudinal streaks on 3 or more to 5 or less images

Poor: Clear longitudinal streaks on 6 or more images, which were unusable.

<Observation of Edge-Scratched Surface>

The surface of the intermediate transfer belt at a portion corresponding to a site in contact with an edge portion (edge-scratched portion) of the A4 size paper was observed using LEXT OLS4100 manufactured by Olympus Corporation to confirm the presence of particle exfoliation.

The results are presented in Tables 2 and 3.

TABLE 2

| | | | Example 1 | Example 2 | Example 3 | Example 4 | Example 5 |
|---|---|---|---|---|---|---|---|
| Intermediate transfer belt | | | A | B | C | D | E |
| Prescription of elastic layer | Prepolymer | CORONATE 4095 (Tosoh Corporation) | 100 | 100 | 100 | 100 | 100 |
| | Isocyanate | CORONATE HX (Tosoh Corporation) | | 10 | 20 | | 10 |
| | Phosphate type (flame retardant) | EXOLIT OP550 (CLARIANT CHEMICALS K.K.) | 30 | 50 | 50 | | 50 |
| | Metal hydroxide (flame retardant) | BFO13 (Nippon Light Metal Co., Ltd.) | 50 | 50 | 50 | 50 | 50 |
| | Phosphinic acid metal salt (flame retardant) | EXOLIT OP930 (CLARIANT CHEMICALS K.K.) | | | | 25 | |
| | Phosphate type (flame retardant) | CR-741 (DAIHACHI CHEMICAL INDUSTRY CO., LTD.) | | | | | 20 |
| | Low molecular weight polyol | TMP (MITSUBISHI GAS CHEMICAL COMPANY, INC.) | | | 2.5 | 3 | |
| | Catalyst | U-CAT SA-1 (San-Apro Ltd.) | 0.3 | 0.3 | 0.3 | 0.3 | 0.3 |
| | Organic solvent | Cyclohexanone (Kanto Chemical Co., Inc.) | | | | 45 | |
| Particle | TOSPEARL 120 (Momentive Performance Materials Inc.) EPOSTAR M30 (NIPPON SHOKUBAI CO., LTD.) | | Good | Good | Good | Good | Good |
| Intermediate characteristics | UL94 combustibility evaluation results | | VTM-1 | VTM-0 | VTM-0 | VTM-1 | VTM-0 |
| | Martens hardness [N/mm$^2$] | | 0.45 | 0.51 | 0.55 | 0.60 | 0.48 |
| | Elastic power [%] | | 60 | 65 | 72 | 81 | 66 |
| | Particle embedment rate [%] | | 52 | 60 | 55 | 63 | 61 |
| Belt evaluation results | Transfer rate | | Medium | Medium | Good | Medium | Good |
| | Edge-scratched portion (particle exfoliation) | | a little | a little | slight | slight | a little |

TABLE 2-continued

| | | | Example 6 | Example 7 | Example 8 | Example 9 | Example 10 |
|---|---|---|---|---|---|---|---|
| Intermediate transfer belt | | | F | G | H | I | J |
| Prescription of elastic layer | Prepolymer | CORONATE 4095 (Tosoh Corporation) | 100 | 100 | 100 | 100 | 100 |
| | Isocyanate | CORONATE HX (Tosoh Corporation) | 20 | 10 | 20 | | 20 |
| | Phosphate type (flame retardant) | EXOLIT OP550 (CLARIANT CHEMICALS K.K.) | 50 | 50 | 50 | | 30 |
| | Metal hydroxide (flame retardant) | BFO13 (Nippon Light Metal Co., Ltd.) | 50 | | | 30 | 50 |
| | Phosphinic acid metal salt (flame retardant) | EXOLIT OP930 (CLARIANT CHEMICALS K.K.) | | 50 | 30 | 30 | |
| | Phosphate type (flame retardant) | CR-741 (DAIHACHI CHEMICAL INDUSTRY CO., LTD.) | 20 | 20 | 30 | 20 | 30 |
| | Low molecular weight polyol | TMP (MITSUBISHI GAS CHEMICAL COMPANY, INC.) | 2.5 | | 2.5 | 3 | 4 |
| | Catalyst | U-CAT SA-1 (San-Apro Ltd.) | 0.3 | 0.3 | 0.3 | 0.3 | 0.3 |
| | Organic solvent | Cyclohexanone (Kanto Chemical Co., Inc.) | | | | 50 | |
| Particle | TOSPEARL 120 (Momentive Performance Materials Inc.) | | Good | | | | |
| | EPOSTAR M30 (NIPPON SHOKUBAI CO., LTD.) | | | Good | Good | Good | Good |
| Intermediate characteristics | UL94 combustibility evaluation results | | VTM-0 | VTM-0 | VTM-0 | VTM-0 | VTM-0 |
| | Martens hardness [N/mm$^2$] | | 0.52 | 0.58 | 0.30 | 0.60 | 0.57 |
| | Elastic power [%] | | 78 | 69 | 84 | 82 | 85 |
| | Particle embedment rate [%] | | 57 | 65 | 70 | 55 | 62 |
| Belt evaluation results | Transfer rate | | Excellent | Good | Excellent | Good | Excellent |
| | Edge-scratched portion (particle exfoliation) | | slight | a little | slight | slight | slight |

TABLE 3

| | | | Comparative Example 1 | Comparative Example 2 | Comparative Example 3 | Comparative Example 4 | Comparative Example 5 |
|---|---|---|---|---|---|---|---|
| Intermediate transfer belt | | | K | L | M | N | O |
| Prescription of elastic layer | Prepolymer | CORONATE 4095 (Tosoh Corporation) | 100 | 100 | 100 | 100 | 100 |
| | Isocyanate | CORONATE HX (Tosoh Corporation) | 10 | 30 | 10 | 20 | 20 |
| | Phosphate type (flame retardant) | EXOLIT OP550 (CLARIANT CHEMICALS K.K.) | | | 50 | 50 | 50 |
| | Metal hydroxide (flame retardant) | BFO13 (Nippon Light Metal Co., Ltd.) | | | 100 | | |
| | Phosphinic acid metal salt (flame retardant) | EXOLIT OP930 (CLARIANT CHEMICALS K.K.) | | | | 100 | |
| | Phosphate type (flame retardant) | CR-741 (DAIHACHI CHEMICAL INDUSTRY CO., LTD.) | | | | | 50 |
| | Low molecular weight polyol | TMP (MITSUBISHI GAS CHEMICAL COMPANY, INC.) | 5 | 10 | | 2.5 | 2.5 |
| | Catalyst | U-CAT SA-1 (San-Apro Ltd.) | 0.3 | 0.3 | 0.3 | 0.3 | 0.3 |
| | Organic solvent | Cyclohexanone (Kanto Chemical Co., Inc.) | | | | | |
| Particle | TOSPEARL 120 (Momentive Performance Materials Inc.) | | Good | Good | Good | Good | Good |
| | EPOSTAR M30 (NIPPON SHOKUBAI CO., LTD.) | | | | | | |
| Intermediate characteristics | UL94 combustibility evaluation results | | not | not | VTM-0 | VTM-0 | VTM-2 |
| | Martens hardness [N/mm$^2$] | | 0.28 | 0.45 | 0.75 | 0.80 | 0.25 |
| | Elastic power [%] | | 87 | 91 | 45 | 61 | 63 |
| | Particle embedment rate [%] | | 52 | 60 | 55 | 63 | 61 |
| Belt evaluation results | Transfer rate | | Good | Good | Poor | Poor | Good |
| | Edge-scratched portion (particle exfoliation) | | many | a little | a little | slight | slight |

Tables 2 and 3 show that abnormal longitudinal streak images are not caused (good transferability) in Examples 1 to 10.

On the other hand, as for Comparative Examples, Comparative Examples 1 and 2 showed good transferability, but were evaluated as "not" in the combustibility evaluation and therefore rated as NG because of no addition of flame retardant. Comparative Examples 3 and 4 were evaluated as "poor" in the transfer rate and therefore rated as NG because the Martens hardness of the elastic layer was excessively increased by adding an excessive amount of powdery flame retardant. Comparative Example 5 was evaluated as "VTM-2" (cotton ignition by drops) in the combustibility evaluation and therefore rated as NG because an excessive amount of liquid frame retardant CR-741 (DAIHACHI CHEMICAL INDUSTRY CO., LTD.) was added.

That means, in prescription design of the urethane rubber, it is impossible to satisfy desired characteristics at the same time unless types and amounts of materials are appropriately combined.

As described above, embodiments of the present invention makes it possible to provide an intermediate transfer belt having excellent followability to irregularity of a recording medium, high flame retardancy, and excellent durability. In addition, use of the intermediate transfer belt makes it possible to provide an intermediate transfer type image forming apparatus in particular suitable for forming a full-color image.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An intermediate transfer belt suitable to receive a transferred toner image obtained by developing a latent image formed on an image bearer with a toner, the belt comprising:

a base layer on a first side of the belt; and an elastic layer having a top side and a bottom side, the bottom side being laminated on the base layer and the top side forming the second side of the belt, the elastic layer comprising an ether-based urethane rubber and particles, wherein particles are embedded in a surface direction on the outermost surface of the elastic layer, wherein the elastic layer has a flame retardancy of vertical thin material (VTM)-1 or higher in UL94-VTM test, and wherein the intermediate transfer belt has a Martens hardness of 0.3 to 0.6 N/mm$^2$ and an elastic power of 60% to 85%.

2. An image forming method, comprising:

developing, with a toner, a latent image formed on an image bearer capable of carrying a toner image to form the toner image;

primarily transferring the toner image developed in the developing onto an intermediate transfer belt; and secondarily transferring the toner image carried on the intermediate transfer belt onto a recording medium, wherein the intermediate transfer belt comprises a base laver on a first side of the belt and an elastic layer having a top side and a bottom side, the bottom side being laminated on the base layer and the top side forming the second side of the belt, the elastic layer comprising an ether-based urethane rubber and particles, wherein particles are embedded in a surface direction on the outermost surface of the elastic layer, wherein the elastic layer has a flame retardancy of vertical thin material (VTM)-1 or higher in UL94-VTM test, and wherein the intermediate transfer belt has a Martens hardness of 0.3 to 0.6 N/mm$^2$ and an elastic power of 60% to 85%.

3. The belt of claim 1, wherein the elastic layer comprises at least two types of flame retardants.

4. The belt of claim 1, wherein the particles comprise spherical particles having an average particle diameter of 5 μm or less.

5. The belt of claim 1, which is a seamless belt.

6. An image forming apparatus, comprising:

an image bearer configured for forming thereon a latent image, and suitable for carrying a toner image;

a development device comprising a toner, configured to develop the latent image formed on the image bearer with the toner to form the toner image;

the belt of claim 1, onto which the toner image developed by the development device is primarily transferred; and a transfer device configured to secondarily transfer the toner image carried on the belt onto a recording medium.

7. The apparatus of claim 6, wherein the image forming apparatus is a full-color image forming apparatus comprising a plurality of pairs of the image bearer and the development device, in which the image bearers are arranged in series and the development devices respectively contain different color toners.

8. The belt of claim 1, wherein the base layer has an average thickness in a range of from 30 to 150 μm.

9. The belt of claim 1, wherein the base layer has an average thickness in a range of from 40 to 120 μm.

10. The belt of claim 1, wherein the base layer has an average thickness in a range of from 50 to 80 μm.

11. The belt of claim 1, wherein the ether-based urethane rubber comprises, in polymerized form, polypropyleneglycol.

12. The belt of claim 1, wherein the ether-based urethane rubber comprises, in polymerized form, polytetramethylene glycol.

13. The belt of claim 11, wherein the ether-based urethane rubber comprises, in polymerized form, polytetramethylene glycol.

14. The belt of claim 1, wherein the base layer comprises a base layer resin and an electric resistance adjusting agent.

15. The belt of claim 14, wherein the base layer resin comprises a fluorine resin.

16. The belt of claim 14, wherein the base layer resin comprises a polyimide and/or polyamideimide resin.

17. The belt of claim 1, wherein the elastic layer has an irregular surface due to the particles.

18. The belt of claim 14, wherein the electric resistance adjusting agent comprises zinc oxide, tin oxide, titanium oxide, zirconium oxide, aluminum oxide, and/or silicon oxide.

19. The belt of claim 1, wherein the particles are in a monoparticulate state, having substantially no overlap among the particles in a layer thickness direction and substantially no complete embedment of the particles in the elastic layer.

20. The belt of claim 1, which is symmetric in a thickness direction.

* * * * *